US006450924B1

(12) United States Patent
Block

(10) Patent No.: US 6,450,924 B1
(45) Date of Patent: Sep. 17, 2002

(54) FINGER EXERCISE DEVICE

(75) Inventor: Robert S. Block, Marina Del Rey, CA (US)

(73) Assignee: Block Patents, Inc., Reno, NV (US)

( * ) Notice: Subject to any disclaimer, the term of this patent is extended or adjusted under 35 U.S.C. 154(b) by 0 days.

(21) Appl. No.: 09/414,491

(22) Filed: Oct. 8, 1999

(51) Int. Cl.[7] ..... A63B 23/16
(52) U.S. Cl. ..... 482/48; 482/47; 482/44
(58) Field of Search ..... 482/44, 49, 124, 482/47, 121; 601/40, 47; 602/21, 5, 22, 64

(56) References Cited

U.S. PATENT DOCUMENTS 4,875,469 A * 10/1989 Brook et al. ..... 482/49
5,447,490 A * 9/1995 Fula et al. ..... 482/49

* cited by examiner

*Primary Examiner*—Jerome W. Donnelly
(74) *Attorney, Agent, or Firm*—Burns, Doane, Swecker & Mathis, LLP

(57) ABSTRACT

A portable finger exercising device for exercising and strengthening the muscles responsible for controlling the movement of the fingers, hand and arm of a human. The device can be configured to exercise and strengthen the muscles of the fingers and hand responsible for forming a closed-fist, as well as the muscles responsible for straightening fingers from the closed-fist position. During either movement, the muscles of the fingers, hand and arm are exercised by moving each finger against a counteracting force exerted by resilient or elastic members of the finger exercising device. The finger exercise device includes a base member or a glove-like body member which is adapted to be adjustably and removable attached to an operator's hand. The base member or body member is capable of releasably receiving a plurality of resilient or elastic members at locations generally corresponding to the location of the operator's fingers. During operation of the device, the resilient members are stretched and the muscles of the fingers are exercised by being forced to move against the resistive force exerted by the resilient members. To provide the most effective and intense work-out for the muscles of the fingers and hand of the operator, the finger exercise device includes interchangeable parts which allows the device to be custom-fit to the hand of the operator, as well as providing the operator the ability to vary the intensity of the workout by adjusting the force exerted by the resilient members.

13 Claims, 7 Drawing Sheets

FINGER EXERCISE DEVICE

BACKGROUND OF THE INVENTION

1. Field of the Invention

The present invention relates to a portable finger exercise device, and more particularly, to a device for exercising and strengthening the muscles responsible for controlling the movement of the fingers, hand and arm of a human.

2. Brief Description of the Related Art

Devices for exercising the arms ands hand of a human have been proposed in the past. For example, one such device includes an elongate spring-like member having outwardly extending ends on which are mounted hand-grip members for enhancing the ability of the operator to grip and compress the ends of the spring toward each other. While such a device provides some resistance to several groups of muscles of the arms and hands of the operator, it is not adjustable for different operator's needs, does not allow selective and adjustable resistance for targeting specific fingers for exercise and does not provide for both adduction and abduction.

Another prior device for exercising the muscles of the fingers and hand is essentially a small rubber or rubberized thermoplastic ball. When placed in the palm of the hand, the ball is slightly collapsed by a squeezing action of the fingers and hand. Accordingly, the ball provides a degree of resistance to the muscles of the fingers and hand responsible for forming a closed-fist. This prior device does not provide adjustable resistance, is not adaptable for targeting specific fingers for exercise and does not provide for both adduction and abduction.

There remains a need for an exercise device for exercising and strengthening the muscles responsible for controlling the movement of the fingers, hand and arm of an operator which allows the operator to select specific fingers of the hand to be exercised, which allows the operator to vary the amount of resistance to be imparted to the fingers being exercised and which allows the operator to selectively exercise both abductor and abductor muscles of the fingers, hand and arm.

SUMMARY OF THE INVENTION

The invention is directed to a portable finger exercise device for exercising and strengthening the muscles responsible for controlling the movement of the fingers, hand and arm of a human operator.

The finger exercise device includes a base member or a glove-like body member which is adapted to be adjustably and removable attached to an operator's hand. The base member or body member is capable of releasably receiving a plurality of resilient or elastic members at locations generally corresponding to the location of the operator's fingers.

In a variant of the present invention, a first end of the resilient members is connected to a finger member attached to a finger of a human operator and a second end is connected to the base member. In another variant, the first end of the resilient members is connected to a tip section located at an end of the operators finger and the second end is attached to the body member a set distance from the tip section. In yet another variant of the present invention, the glove-like body member includes a elongate pocket formed along at least one finger and an elongate elastic member inserted into the elongate pocket.

During operation of a preferred embodiment of the finger exercise device of the present invention, the fingers of the operator are brought from an initial position, where the fingers are in an extended or straightened position, into a secondary position, where the fingers form a closed-fist. As the operator forms a closed-fist, the muscles of the fingers, hand and arm are exercised by moving each finger against a counteracting force exerted by a resilient member of the finger exercising device. This movement is vigorously repeated, thereby exercising and strengthening the muscles of the fingers, hand and arm. Alternatively, the finger exercise device can be configured to simultaneously or independently exercise the muscles responsible for straightening the fingers from a closed-fist position.

To provide the most effective and intense work-out for the muscles of the fingers, hand and arm of the operator, the finger exercise device includes interchangeable parts, allowing the device to be custom-fit to the hand of the operator, as well as allowing the operator to vary the intensity of the workout by adjusting the force exerted by the resilient members.

Still other objects, features, and attendant advantages of the present invention will become apparent to those skilled in the art from a reading of the following detailed description of embodiments constructed in accordance therewith, taken in conjunction with the accompanying drawings.

BRIEF DESCRIPTION OF THE DRAWINGS

The invention of the present application will now be described in more detail with reference to preferred embodiments of the apparatus and method, given only by way of example, and with reference to the accompanying drawings, in which.

DESCRIPTION OF THE PREFERRED EMBODIMENTS

Figure 1:
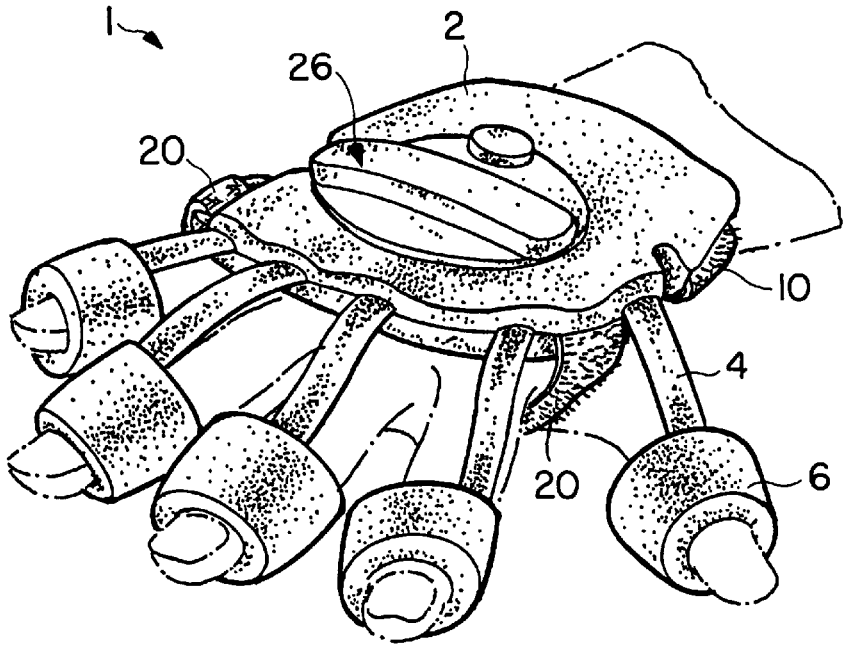
FIG. 1 is a perspective view of a first embodiment of the device attached to the right-hand of an operator.
Figure 2:
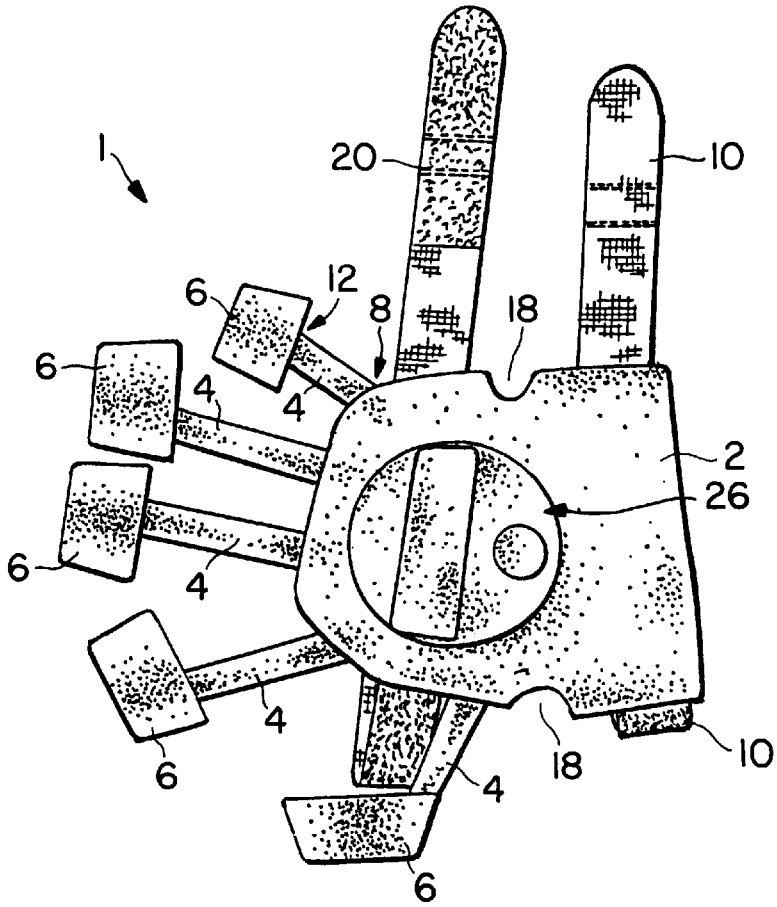
FIG. 2 shows a top view of the first embodiment of the device according to the invention.
Figure 3:
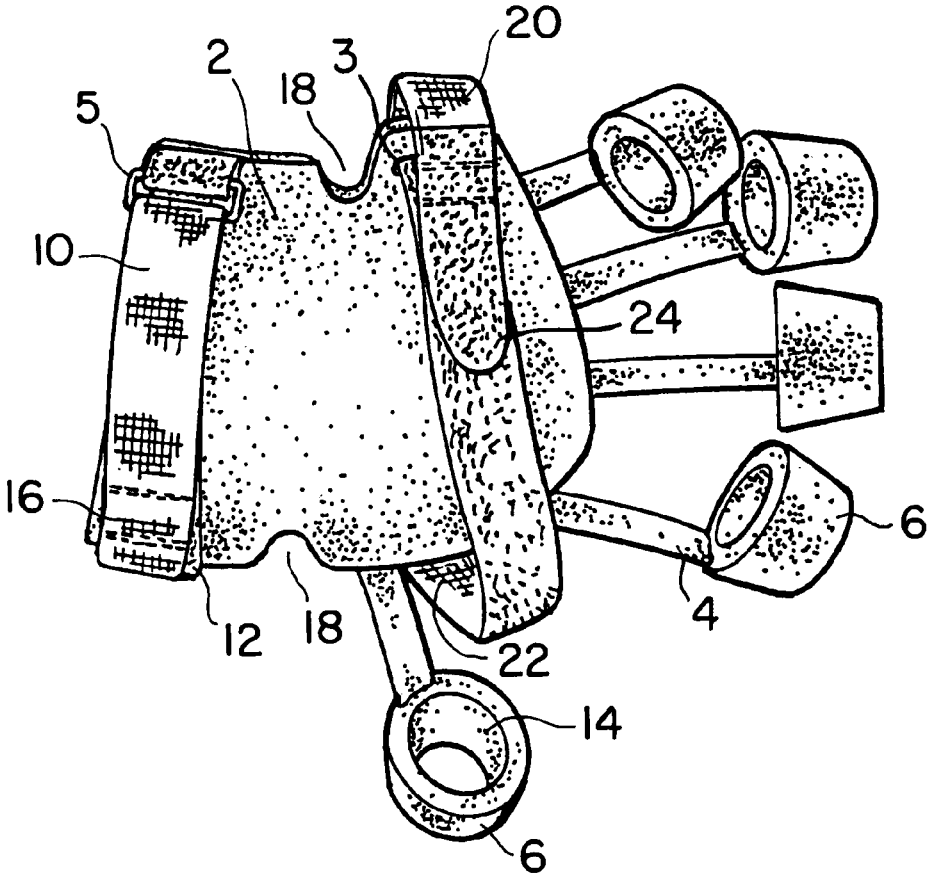
FIG. 3 shows a bottom view of the first embodiment of the device according to the invention.

The present invention relates to a portable finger exercise device that can be readily attached to the hand of an operator and operated to exercise and strengthen the muscles responsible for controlling the movement of the fingers, hand and arm of a human. According to the several preferred embodiments of the present invention, the device can be configured to exercise and strengthen the muscles responsible for forming a closed-fist, as well as the muscles responsible for straightening fingers from the closed-fist position. In either configuration, the muscles of the fingers, hand and arm are exercised by moving the fingers against a counteracting force exerted by stretching of the resilient members of the finger exercising device. To provide the most effective and intense work-out, the finger exercise device of the preferred embodiments includes interchangeable parts, allowing the device to be custom-fit to the hand of the operator, as well as allowing the operator to vary the intensity of the workout by adjusting the force exerted by the resilient members. Referring to FIGS. 1–3, a first preferred embodiment of the present invention is illustrated. According to FIG. 2, the finger exercise device 1 is shown from a top view and includes a base member 2 which can be releasably attached to the hand of an operator with straps 10, 20. Base member 2 is preferably formed of a sturdy, somewhat pliable, and soft material, e.g., dense foam. Base member 2 is optionally provided with notches 18, which allow the base member to flex somewhat at the notches. As illustrated in FIGS. 1 and 2, base member 2 is optionally provided with a display or presentation area 26, which can be provided with brand, source, or other indicia.

The first preferred embodiment of the finger exercise device of the present invention includes a plurality of rubber-band like, elongate resilient members 4. Each elongate resilient member 4 includes a first end 12 and a second end 8. The resilient members 4 are preferably formed of any resilient material, e.g., silicone rubber, natural or other synthetic rubber. The second ends 8 of the resilient members 4 attach to the base member 2 at locations generally corresponding to the location of the base of the fingers and thumb of a typical operator's right or left hand. The first ends 12 of the resilient members 4 connect to corresponding finger members 6.

The finger members 6 are preferably formed as loops of slightly deformable and soft material, e.g., foam, which include a passageway 14 extending therethrough and are sized to receive a finger of a human, see FIG. 3. The finger members 6 attach to the operator's fingers by way of a friction fit or by any means that prevents movement along a longitudinal axis of the finger after the operative position of the finger member 6 has been set. It is noted that the operative position of the finger members 6 is the position where the finger member 6 is snugly held to the finger of an operator, and the resilient member 4 connected thereto is in an extended position, so as to include little or no slack. FIG. 1 illustrates the attachment of five finger members 6 to the fingers of a typical operator. While the finger members 6 are shown as cylindrical tubular members in FIGS. 1–3, it is contemplated that the finger members 6 could be shaped or arranged in any manner that provides a snug fit on a finger, including frustoconically shaped finger members, without departing from the scope of the invention.

Referring to FIG. 3, straps 10, 20 are provided for releasably and securely attaching the base member 2 to the hand, preferably to the back of a hand of a user. First ends 12, 22 of each of the straps 10, 20 are attached to the base member 2 while the second ends 16, 24 of straps 10, 20 respectively, are threaded through either an aperture 3 in the base member or through a circular eyelet 5, separately attached to the base member 2. After second ends 16, 24 of straps 10, 20 are threaded through aperture 3 or eyelet 5, the straps are tightened around the operator's hand by pulling the second ends of the straps in the direction of the first end and then fastening the second ends of the straps onto the backs of straps 10, 20 with a suitable fastener, e.g., VELCRO® brand hook and loop-pile type fastener.

In FIG. 3, strap 10 is located in a position wherein the strap surrounds the hand of the operator at the base of the palm. Strap 20 is located in a position wherein the strap surrounds the hand of the operator at the base of the fingers of the operator. While the use of multiple straps with VELCRO® are shown, the attachment of the body member 2 to a hand of an operator can be accomplished by a single strap, by straps that are formed integrally with the body member, or by any conventional means that would provide secure, releasable, and adjustable attachment of a body member to the hand of an operator. For example, instead of hook and loop-pile type fasteners, simple hooks can be inserted into grommets formed in the straps. Other suitable fastening devices will be readily apparent to one of ordinary skill in the art.

FIG. 1 illustrates the first preferred embodiment of the present invention operatively attached to a hand of an operator. As shown, the device is in an initial position, in which the fingers of the operator are temporarily straightened and held in a stationary position, and the resilient members 4 are in an unstretched or slightly stretched state. As the operator begins to form a closed-fist, the resilient members 4 are stretched and the muscles of the finger, hand and arm of the operator are contracted against a counteracting force exerted by the stretching of the resilient members 4. This is referred to as the force-to-close movement. By forcing the finger muscles to contract against the force of the resilient members, the finger exercising device of the present invention exercises the abductor muscles of the user's fingers, hand and lower arm.

After forming a closed-fist, the user's fingers are slowly straighten back to the initial position, shown in FIG. 1. During this movement, the resilient members 4 exert a force on the fingers directing them into the initial position. This is referred to as the force-to-open movement. By slowly straightening the fingers, thereby resisting this force, the operator also exercises the abductor muscles of the fingers, hand and arm. By alternatingly performing a force-to-open and a force-to-close movement over a period of time, the abductor and abductor muscles of the operator's fingers, hand and arm, are exercised and strengthened.

While FIGS. 1–3 illustrate the use of five resilient members 4, it is contemplated that fewer resilient members 4 could be implemented, for example, four or fewer resilient members 4 could be attached to the base member of the finger exercise device. Accordingly, a particularly desirable feature of the device of the present invention is that it allows the operator to directly target specific fingers for exercise, without extraneous resilient members obstructing operation.

To facilitate the progressive strengthening of the muscles, the resilient members 4 can be provided with releasable connections at the point of attachment to the base member 2. Releasable connections allow the resilient member 4 to be detached from the base member 2 and replaced with a resilient member 4 having a higher spring constant, which is less resilient and requires more force to stretch. Detachable resilient members provide the ability to vary the resistance of the resilient members depending on how challenging the operator desires the work-out to be.

In addition to releasable resilient members 4, the finger exercise device of the present invention can be provided with detachable finger members 6. Detachable finger members 6 can be released from the resilient members 4 and replaced with a larger or smaller finger member 6 depending on the size of the operator's fingers. Alternatively, finger members capable of being adjustably fitted to the size of the operator's finger could be supplied with the device.

According to yet another variant of the first embodiment, the resilient members 4 and base member 2 can be provided with complementary interlocking fastening members, allowing the effective length of the resilient members to be shortened without requiring replacement of the resilient member. Interlocking fastening members provide operators with especially long or short fingers the ability to install resilient members having a proper length to fit their uniquely shaped hands. It is also contemplated that the use of complementary interlocking fastening members would provide the ability to vary the resiliency of the resilient members 4, thereby allowing the operator to vary the intensity of the work-out without having to change resilient members. Exemplary complementary interlocking fastening members include, but are not limited to, post fasteners, hook and loop-pile type fasteners, hooks and grommets, clamps on the base member which receive the resilient members, and belt-buckle-type clasps.

In FIGS. 1–3, the finger exercise device is shown designed for operation on the operator's right hand. However, it is contemplated that the device could be designed for operation on an operator's left hand without departing from the scope of the invention. Furthermore, the finger exercise device of the present invention could be made to generally fit different types of people, for example, a womens' or mens' size with corresponding small, medium and large variations for each gender. Each version would come supplied with a correspondingly sized set of finger members 6, resilient members 4 and a base member 2, providing the capability of more precisely fitting the hand characteristics of the specific operator.

Referring to FIGS. 4–7, a second embodiment of the finger exercise device of the present invention is illustrated. According to the second embodiment, the finger exercise device includes a glove-like body member part 30 into which the hand of the operator can be inserted. The glove 30 of the finger exercising device of the second embodiment of the invention is made from a material which promotes the easy insertion of the hand of an operator, in addition to allowing the fingers to be easily moved during exercise. Furthermore, it is preferable that the glove 30 is made from a breathable material, allowing the user's hand to be ventilated and cooled during exercise.

Figure 4:
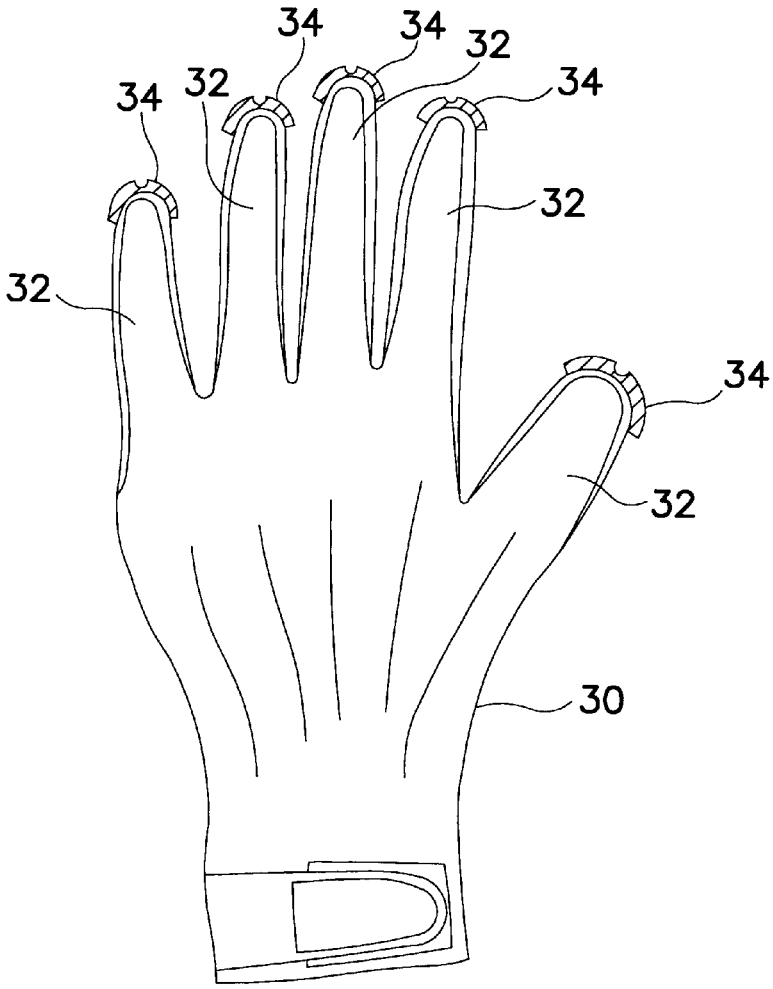
FIG. 4 shows a top view of a second embodiment of the device according to the invention.
Figure 5:
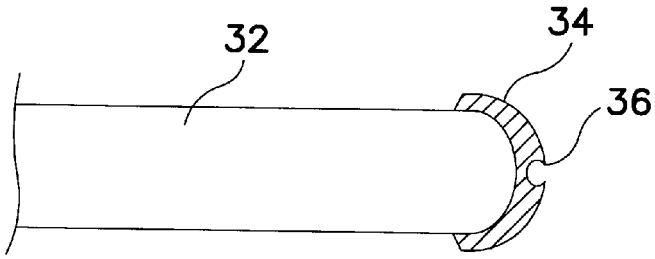
FIG. 5 shows a top view of one of the fingers of the second embodiment of the device of the invention.
Figure 6:
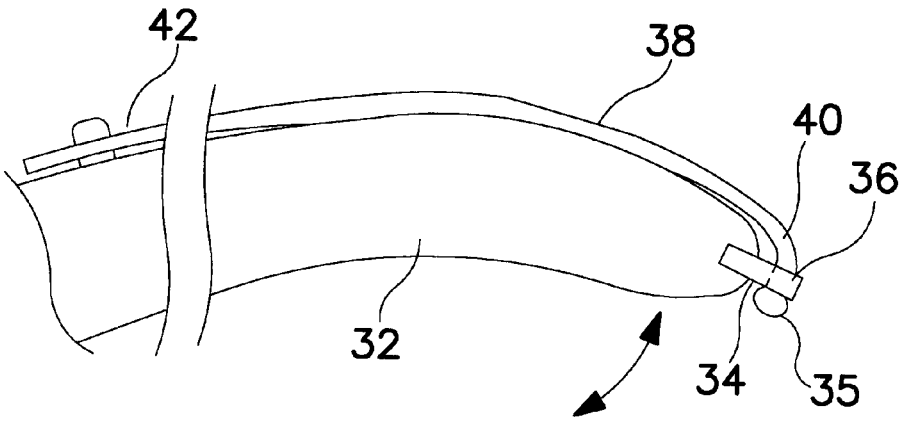
FIG. 6 shows a side view of one of the fingers of a first arrangement of the second embodiment of the invention.
Figure 7:
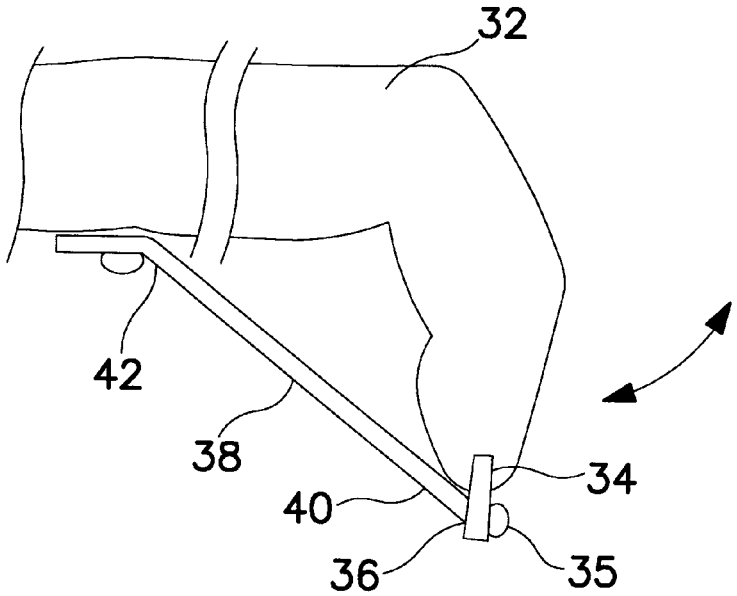
FIG. 7 shows a side view of one of the fingers of a second arrangement of the second embodiment of the invention.

FIG. 5 illustrates a cross-section of one of the fingers 32 of the glove 30 according to a preferred second embodiment of the present invention, taken in the plane of illustration of FIG. 4. The finger 32 includes a tip section 34 made from a solid material, such as a metal or a plastic. Tip sections 34 are attached to ends of the fingers 32 and/or thumb of the glove 30 by any known means of attachment, such as by sewing or glueing. The tip section 34 includes a groove 36 having an opening sized to be smaller than the diameter of the groove 36. As shown in FIGS. 6 and 7, the groove 36 and corresponding opening are shaped to receive an enlarged head 35 formed at an end of a resilient member 38. The finger exercise device preferably includes a plurality of the rubber-band like, elongate resilient members 38. Each elongate resilient member 38 includes a first end 40 and a second end 42. The resilient members 38 are preferably formed of any resilient material, e.g., silicone rubber, natural or other synthetic rubber.

The second ends 42 of the resilient members 38 are securely attached to an area of the glove 30 extending from approximately the base of the user's fingers to the area near the user's wrist. Depending upon which muscles are to be exercised, the area of the glove to which the second end of the resilient member 38 is attached is located on either the top of the operator's hand or on the bottom of the operator's hand. If the second end 42 of the resilient member 38 is attached to an area of the glove located on the top of the user's hand, as shown in FIG. 6, the resilient member 38 is stretched as the fingers are brought into the shape of a closed-fist. The stretching of the resilient member exerts a counterforce against which the fingers are moved as they are brought into a shape of the closed-fist. The configuration characterized by the attachment of the second end 42 of the resilient member 38 to the top of the hand is referred to as a force-to-close arrangement.

Alternatively, the second end 42 of the resilient member 38 can be attached to the glove in an area associated with the bottom of the hand, as shown in FIG. 7. In this arrangement, the resilient member 38 is stretched as the fingers are moved from a closed-fist position to a straightened position. The stretching of the resilient member exerts a counterforce against which the fingers are moved as they are straightened. The configuration characterized by the attachment of the second end 42 of the resilient member 38 to the bottom of the hand is referred to as a force-to-open arrangement.

In both the force-to-close arrangement and the force-to-open arrangement, the second ends 42 of the resilient members 38 and the area of the glove corresponding either to the top or bottom of the hand or wrist of the operator can be provided with complementary interlocking fastening members. Complementary interlocking fastening members provide the operator the ability to adjust the length and resiliency of the resilient members, whereby the intensity of the work-out can be varied without having to replace resilient members. Exemplary complementary fastening members include, but are not limited to, post fasteners, hook and loop-pile type fasteners, hooks and grommets, clamps on the glove which receive the resilient members, and belt-buckle-type clasps.

Figure 8:
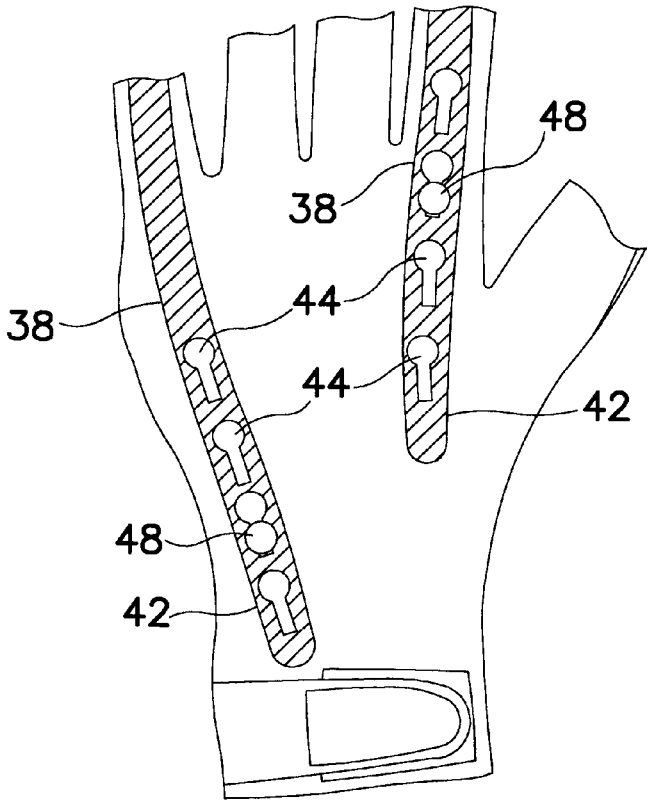
FIG. 8 shows a top view of a preferred variant of an interlocking fastening mechanism.
Figure 9:
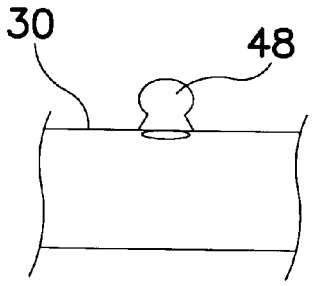
FIG. 9 shows a side view of the preferred variant of the interlocking fastening mechanism.

FIGS. 8 and 9 illustrate one preferred variant of an interlocking fastening mechanism implemented in the second embodiment of the finger exercising device of the present invention. FIG. 8 shows a top-view of a post attachment mechanism 48 located on a left-handed glove at both of a base of an index finger and at a wrist area, corresponding to the fifth finger or pinky of the operator. In the post attachment mechanism 48, the second ends 42 of the resilient member 38 are provided with a series of keyhole-shaped apertures 44. The second ends 42 of the resilient members 38 attach to a post 48 by threading one of the apertures 44 through the post 48 and locking the resilient member into place. Accordingly, the length and resiliency of the resilient members can be varied. The posts 48 are attached to the glove 30 by any known means, such as by a rivot, see FIG. 9.

In an alternative variant, the posts 48 of the interlocking fastening mechanism can be rotatably attached to the glove 30. In such an arrangement, the second ends 42 of the resilient members 38 are attached to the posts by wrapping the resilient members around the rotatable posts, similar to tuning keys on a guitar head. The length and resiliency of the resilient members 38 are varied by rotating the posts, thereby either tightening or loosening the resilient members 38.

Figure 10:
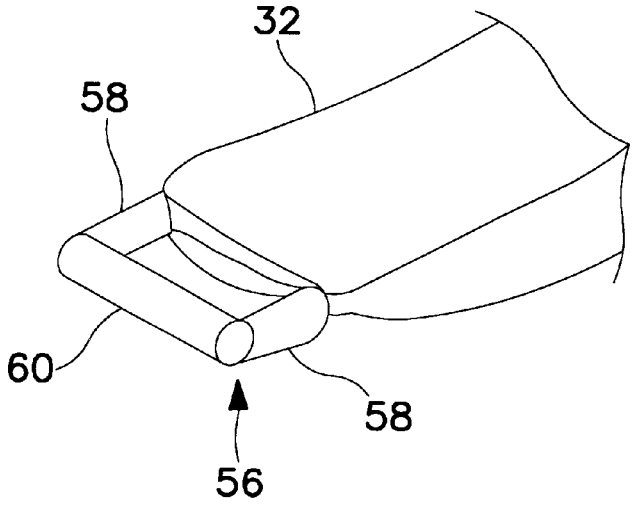
FIG. 10 shows a perspective view of a variant of the second embodiment of the device of the invention.

FIG. 10 illustrates a variant of the second embodiment of the glove-type finger exercise device of the present invention. According to this variant, the tip section includes a swivel mechanism 56 arranged at the tip of one or several fingers 32 of the glove 30. The swivel mechanism 56 includes two posts 58 for supporting a laterally extending cross-bar 60. Similar to the connection of the tip section 34 to the fingers 32 of the glove 30 of the previous embodiment, the swivel mechanisms 56 of the present embodiment are attached to the glove 30 by any known means of attachment, such as by sewing or glueing.

First ends 40 of the resilient members 38 are pivotally attached to the cross-bar 60 of the swivel mechanism 56. The pivotable attachment can be accomplished by any known means, such as by looping the resilient member 38 around the cross-bar 60, or by forming the resilient member with a hook at its first end. The pivotable connection of the resilient member allows the second end 42 of the resilient member 38 to be readily swung around the pivot of the cross-bar, whereby the second end 42 of the resilient member 38 can be attached either to the top or the bottom area of the glove 30 of the finger exercise device. Accordingly, the operator can readily alternate the exercise from a force-to close arrangement to a force-to-open arrangement. The second end 42 of the resilient member is attached to the glove by any known interlocking fastening mechanism, as disclosed previously with respect to the second embodiment of the finger exercise device. While the swivel mechanism 56 has been disclosed as including two posts and a cross-bar, one of ordinary skill in the art would appreciate the use of equivalent structure for pivotally attaching a resilient member to the ends of the fingers of the finger exercise device.

Five or fewer resilient members 38 can be operatively attached to the finger exercise device at a time. As in the first embodiment of the present invention, this is a particularly desirable feature since it allows the operator to directly target specific fingers for exercise, without extraneous resilient members obstructing operation of the device.

Referring to FIGS. 11–14, a third embodiment of the finger exercising device of the present invention is illustrated. According to this embodiment, the finger exercise device includes a glove-like body member part 70 into which the hand of the operator is inserted. Similar to the glove 30 of the second embodiment, the glove 70 of the third embodiment of the finger exercising device is made from a material which allows the hand of the user to be readily inserted and allows the fingers to be easily moved. Furthermore, the glove 70 is made from a breathable material, allowing the operator's hand to be ventilated during exercise. However, rather than being adapted to accept rubber-band like elongate resilient members, the glove 70 includes a plurality of integrally formed pockets 72, 73 for receiving removable, elastic members 74.

Figure 11:
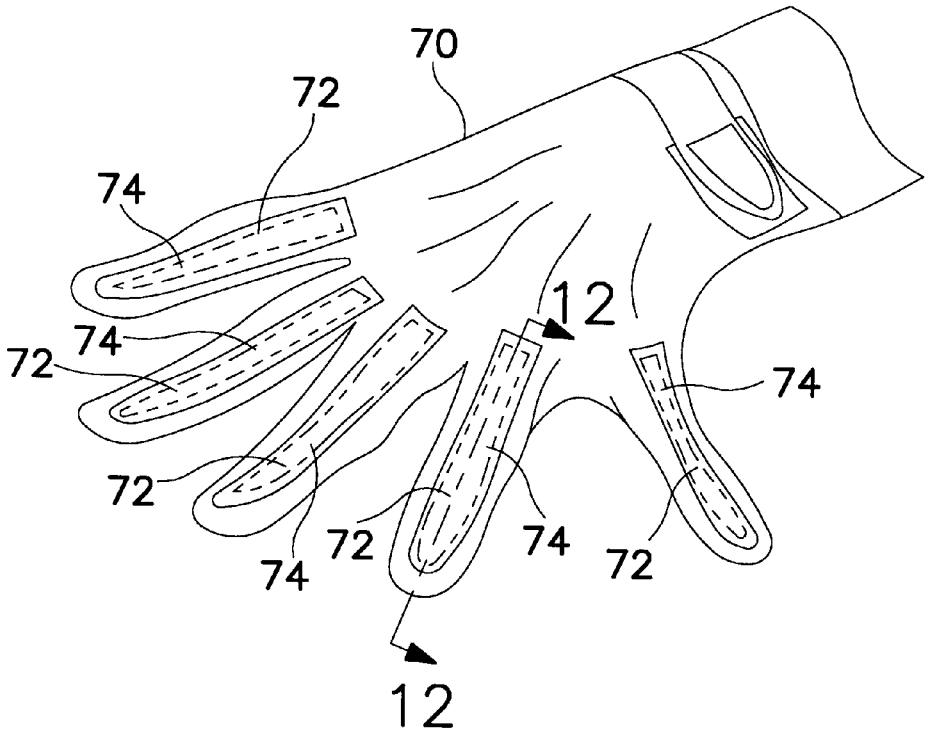
FIG. 11 shows a perspective view of a third embodiment of the device of the invention.
Figure 12:
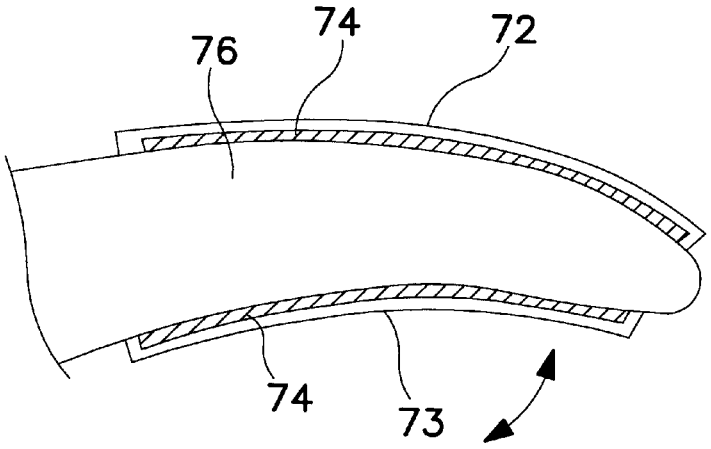
FIG. 12 shows a side view in plane 12—12 according to FIG. 11 of one of the fingers of a first arrangement of the third embodiment of the invention.

FIG. 12 illustrates a cross-section of one of the fingers 76 of the glove 70 of the third embodiment of the present invention, taken at line 12—12 in FIG. 11. The finger 76 includes a pocket 72 formed at the top of the finger, as well as secondary pocket 73 formed at the bottom of the finger. In accordance with the invention, a pocket could be formed at either the top or bottom of a finger of the glove, or a finger could be formed without any pockets, in which case the finger of the operator would not be exercised. Furthermore, the pockets 72, 73 could be formed as an integral part of the glove 70 or alternatively, the pockets could be sewn or glued into the glove 70. Irrespective of how the pockets are formed, the pockets are shaped to securely hold an elongate elastic member 74.

The elongate elastic members 74 are made from a variety of materials, for example, polymers, metals, or a hybrid of polymers and metals, depending on the desired amount of bending resistance that is to be exerted by the elastic member. In addition, the elastic members 74 are formed in two general shapes. The elastic members 74 may be formed as generally planer or flat members, as shown in an operative position in FIG. 12. Alternatively, the elastic members 74 may be formed as curvilinear members, as shown in an operative position in FIG. 13. As will be discussed below, the generally planer or flat elastic members 74 are used in a force-to-close arrangement and the curvilinear elastic members 74 are used in a force-to-open arrangement of the finger exercise device.

The initial position of the force-to-close arrangement is shown in FIG. 12. In the initial position, the fingers of the operator are straightened and held in a stationary position, and the generally planer elastic members 74 are in a substantially unbent state. It is noted that an elastic member 74 can be inserted into the top pocket 72, the bottom pocket 73, or both the top and bottom pockets of each finger 76 of the glove 70. As the operator begins to form a closed-fist, the elastic members 74 are bent and the muscles of the finger, hand and arm of the operator are forced to be contracted against a counteracting force exerted by the bending of the elastic members 74. After forming a closed-fist, the fingers are slowly straightened and returned to the initial position shown in FIG. 12. The movement of the fingers into a closed-fist, and the subsequent straightening of the fingers of the hand is repeated for a substantial number of repetitions, thereby subjecting the finger muscles to contract against the force of the elastic members in a repetitive manner. Accordingly, the finger exercising device of the present invention exercises the abductor muscles of the operator's fingers, hand and lower arm.

Figure 13:
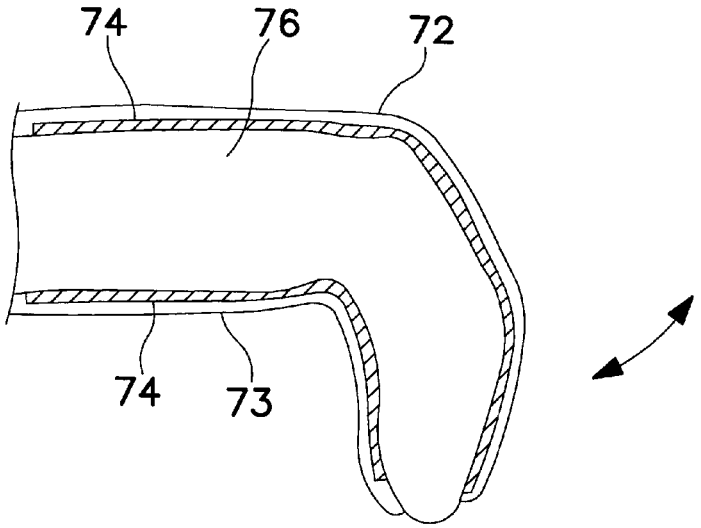
FIG. 13 shows a side view of one of the fingers of a second arrangement of the third embodiment of the device of the invention.

The initial position of the force-to-open arrangement is shown in FIG. 13. In the initial position, the fingers of the operator are temporarily bent and held in the curved position by the curvilinear elastic members 74, which are bent in their relaxed state. As in the force-to-close arrangement, a curvilinear elastic member 74 can be inserted into the top pocket 72, the bottom pocket 73, or both the top and bottom pockets of each finger 76 of the glove 70. From the initial position, the operator begins to straighten the fingers, thereby forcing the muscles to move the finger against a resistive force exerted by the curvilinear elastic member 74 attempting to stay in its initial bent position. Upon fully straightening the fingers, the fingers are moved back to their curved, initial position shown in FIG. 13. The straightening and closing of the hand is repeated for a substantial number of repetitions, thereby exercising the muscles of the fingers, hand and arm against the counterforce exerted by the curvilinear elastic members. Accordingly, the finger exercise device of the present invention exercises the abductor muscles of the operator's fingers, hand and lower arm.

The finger exercise device of the third embodiment can be readily modified to facilitate a progressive strengthening of the muscles achieved through a continued use of the device. By removing an elastic member 74 from the pocket and substituting an elastic member having a higher bending resistance, the operator can quickly vary the amount of force necessary to bend the elastic member. Alternatively, the resistance can be varied by inserting a similarly shaped elastic member 74 into both the top and the bottom pocket. Such an arrangement effectively doubles the amount of force necessary to move the finger. In either alternative, removable elastic members 74 provide the ability to vary the resistance of the elastic members depending on how challenging the operator desires the exercise to be.

Furthermore, particular pockets on the fingers can be left empty, whereby some fingers will not be forced to move against the bending resistance of an elastic member. Accordingly, the operator can directly target specific fingers for exercise.

In FIG. 11, the finger exercise device is shown designed for operation on the operator's right hand. The device can be alternatively designed for operation on an operator's left hand by making the glove 70 fit a left hand. Furthermore, the finger exercise device of the present invention could be made with a glove to generally fit different types of people, for example, a womens' or mens' size with corresponding small, medium and large glove sizes for each gender. Each version would come supplied with correspondingly sized elastic members 74, providing the ability to precisely satisfy the needs of each potential operator.

While the invention has been described in detail with reference to preferred embodiments thereof, it will be apparent to one skilled in the art that various changes can be made, and equivalents employed, without departing from the scope of the invention.

What is claimed is:

1. A finger exercise device comprising:

a body member capable of being attached to a part of at least one finger and a hand of a human operator;

at least one tip section attached to the body member at a location corresponding substantially to an end of the finger attached to the body member; and at least one resilient member having a first end connected to the at least one tip section and a second end connected to the body member a set distance from the at least one tip section;

wherein the at least one tip section includes a groove for releasably receiving the first end of the at least one resilient member.

2. The finger exercise device as in claim 1, wherein the body member includes a glove into which one of a right hand and a left hand of the operator can be inserted.

3. The finger exercise device as in claim 2, wherein the glove is made from a breathable material.

4. The finger exercise device as in claim 1, wherein said resilient means includes an elongated strip of resilient material.

5. The finger exercise device as in claim 1, wherein the body member includes a first portion configured and arranged to be adjacent to the base of an operator's fingers when the exercise device is worn on the operator's hand, and a second portion configured and arranged to be adjacent to the operator's wrist when the exercise device is worn on the operator's hand, the second end of the resilient member is connected to the body member at a location extending from the first portion to the second portion.

6. The finger exercise device as in claim 5, wherein the body member includes a third portion configured and arranged to be adjacent to the top of an operator's hand when the exercise device is worn on the operator's hand, the second end of the resilient member is connected to the third portion.

7. The finger exercise device as in claim 5, wherein the body member includes a fourth portion configured and arranged to be adjacent to the bottom of an operator's hand when the exercise device is worn on the operator's hand, the second end of the resilient member is connected to the fourth portion.

8. The finger exercise device as in claim 5, wherein the second end of the resilient member is releasably connected to the body member by way of a fastening mechanism including one of a post fastener, hook and loop-pile type fastener, hook and grommet fastener, clamps on the glove which receive the resilient members and belt-buckle-type clasps.

9. The finger exercise device as in claim 5, wherein the second end of the resilient member is releasably connected to the body member by way of a rotatable post around which the resilient member is wrapped around and tightened to adjust the length and resiliency of the resilient member.

10. A finger exercise device comprising:

a body member capable of being attached to a part of at least one finger and a hand of a human operator;

at least one tip section attached to the body member at a location corresponding substantially to an end of the finger attached to the body member; and at least one resilient member having a first end connected to the at least one tip section and a second end connected to the body member a set distance from the at least one tip section;

wherein the at least one tip section includes a swivel mechanism to which the first end of the resilient member is pivotally attached.

11. The finger exercise device as in claim 10, wherein the swivel mechanism includes two posts which support a laterally extending cross-bar.

12. The finger exercise device as in claim 1, wherein when the device is in an operative, initial position attached to the hand of the operator, the at least one resilient member is extended so as to remove slack and is capable of being resiliently stretched a set distance.

13. The finger exercise device as in claim 1, wherein when the device is in an operative, initial position attached to the hand of the operator, the at least one resilient member is extended so as to remove slack and is capable of being resiliently stretched a set distance.

* * * * *